US007312770B2

(12) United States Patent
Onishi

(10) Patent No.: US 7,312,770 B2
(45) Date of Patent: Dec. 25, 2007

(54) SUBSTRATE HAVING A LIGHT EMITTER AND IMAGE DISPLAY DEVICE

(75) Inventor: Tomoya Onishi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 521 days.

(21) Appl. No.: 11/043,076

(22) Filed: Jan. 27, 2005

(65) Prior Publication Data

US 2005/0179398 A1 Aug. 18, 2005

(30) Foreign Application Priority Data

Feb. 18, 2004 (JP) ..... 2004-040757

(51) Int. Cl.
*G09G 3/00* (2006.01)

(52) U.S. Cl. ..... 345/75.2; 313/496; 345/74.1; 345/75.1

(58) Field of Classification Search ..... 345/74.1, 345/75.1, 75.2; 313/495–497; 315/169.1, 315/169.2, 167

See application file for complete search history.

(56) References Cited

U.S. PATENT DOCUMENTS 5,592,056 A 1/1997 Peyre et al. ..... 315/169.1
5,764,000 A * 6/1998 Mougin et al. ..... 313/496
5,986,626 A 11/1999 Tanaka ..... 345/74
6,580,223 B2 * 6/2003 Konishi et al. ..... 315/169.3
6,677,706 B1 1/2004 Hara et al. ..... 313/496
6,771,236 B1 8/2004 Konishi et al. ..... 345/80
6,787,986 B2 * 9/2004 Murata et al. ..... 313/496

FOREIGN PATENT DOCUMENTS

JP 2001-243893 9/2001
JP 2002-175764 6/2002

* cited by examiner

*Primary Examiner*—Jimmy H. Nguyen
(74) *Attorney, Agent, or Firm*—Fitzpatrick, Cella, Harper & Scinto

(57) ABSTRACT

An image display device which prevents damage to an electron-emitting device from discharge between a faceplate and a rear plate is provided. A conductive plate 12 including a transparent conductive film is formed over a surface of a substrate 11, a distance specifying member 13 having a plurality of openings is formed on the conductive area 12, a fluorescent material 14 is arranged in the opening, and a conductive film 15 is arranged on the fluorescent material 14 to for a face plate. A resistance $R_x$ between the adjacent conductive films 15 is set larger than a resistance $R_z$, between the conductive film 15 and the conductive area 12. Discharge current generated between each conductive film 15 and a rear plate 21 is caused to flow into the conductive area 12 by applying anode voltage to the conductive area 12, which suppresses influence on an electron-emitting device 23.

23 Claims, 14 Drawing Sheets

WHEN Rx>Rz
V2<0.5×V1 IS MET

SUBSTRATE HAVING A LIGHT EMITTER AND IMAGE DISPLAY DEVICE

BACKGROUND OF THE INVENTION

1. Field of the Invention

The present invention relates to a substrate having a light emitter which emits light by electron beam irradiation for an image display device, such as a field emission display, which utilizes an electron beam. The present invention also relates to an image display device using the substrate and an information display reproducing apparatus using the image display device.

2. Related Background Art

Research and development of the image display device for which a field emission type electron-emitting device, a surface conduction electron-emitting device, and the like are used is in progress for a flat panel display of application.

FIG. 13 shows an example of a display panel of the conventional image display device formed by using the surface conduction electron-emitting device. FIG. 13 is a perspective view schematically showing a structure while the display panel is partially cut off. In FIG. 13, the numeral 31 represents a rear plate, the numeral 32 represents a row-direction wiring, the numeral 33 represents a electron-emitting device, the numeral 34 represents a column-direction wiring, the numeral 40 represents a faceplate, the numeral 41 represents a glass substrate, the numeral 45 represents a metal back, the numeral 46 represents a high-voltage power supply, the numeral 47 represents a fluorescent material layer, and the numeral 48 represents a sidewall.

In the display panel of FIG. 13, a display panel is formed by the rear plate 31, the sidewall 48, and the faceplate 40. In the display panel, the row-direction wirings 32 and the column-direction wirings 34 are formed on the rear plate 31, and a multi-electron beam source is formed by arranging the electron-emitting devices 33 at nodal points where the row-direction wiring 32 and the column-direction wiring 34 intersect each other. On the other hand, the faceplate 40 includes the glass substrate 41, the light emitter such as a fluorescent material layer 47, and the metal back 45. The fluorescent material layer 47 includes a fluorescent material and a distance specifying member (such as a light absorption member) inside the glass substrate 41. The light emitter (such as a fluorescent material) emits light by the electron beam irradiation. The distance specifying member restrains color mixing of the fluorescent material while suppressing reflection of outside light. The metal back 45 reflects the light which is emitted from the fluorescent material layer 47 toward the outside of the display panel. Usually the distance specifying member is formed in a shape of a matrix or a stripe which is made of a black material (such as graphite flake). High voltage is applied to the fluorescent material layer 47 and the metal back 45 from the external high-voltage power supply 46 through a high voltage-in terminal, and the fluorescent material layer 47 and the metal back 45 form an anode electrode. In a process of manufacturing the fluorescent material layer 47, it is possible to adopt a process of forming the distance specifying member as the member having a plurality of openings and then arranging the light emitter (fluorescent material) in each opening. Therefore, the distance specifying member can also be referred to as the member having the plurality of openings.

In the image display device having the above structure, an electric field is generated between the rear plate 31 and the faceplate 40 by applying the high voltage (sometimes referred to as "accelerating voltage" or "anode voltage") to the metal back 45 which is of a part of the anode electrode. The electric field causes the electron-emitted from the electron-emitting device 33 to collide with the fluorescent material, which allows the fluorescent material to emit the light to display an image. At this point, because brightness of the image display device depends largely on the accelerating voltage, in order to increase the brightness, it is necessary to increase the accelerating voltage. Further, in order to realize a reduction in thickness of the image display device, it is necessary to decrease the distance between the rear plate 31 and the faceplate 40. This results in the generation of the considerably high electric field between the rear plate 31 and the faceplate 40.

The flat panel display in which the high electric field is applied between the rear plate and the faceplate in the above-described way is disclosed in Japanese Patent Application Laid-Open No. 10-326583.

SUMMARY OF THE INVENTION

However, there are the following problems in the flat panel display in which the high electric field is applied between the rear plate and the faceplate.

FIG. 14 schematically shows a cross section in an X-direction of FIG. 13. In FIG. 14, the numeral 43 represents a distance specifying member, and the numeral 44 represents a fluorescent material.

In the structure of FIG. 14, the faceplate 40 has the metal back 45 which is formed so that the fluorescent material 44 and the distance specifying member 43 are covered with the metal back 45, and the metal back 45 is formed over the surface of the image display area while formed in one continuous film. In the state of things, when discharge is generated from any cause between the rear plate 31 and the faceplate 40, large current flows from the faceplate 40 to the rear plate 31. A value of the current is determined by charge accumulated in electrostatic capacity formed between the faceplate 40 and the rear plate 31. Therefore, as the distance between the faceplate 40 and the rear plate 31 is decreased and an area is increased, the discharge current is increased. Because the discharge current flows through the electron-emitting device 33, the row-direction wiring 32, and the column-direction wiring 34 which are formed on the rear plate 31, when the value of the discharge current is large, large damage is generated in the electron-emitting device 33, and a fatal flaw is generated in the image displayed on the image display device.

In order to solve the above problems, an object of the invention is to provide an image display device which suppresses influence by the discharge between the faceplate and the rear plate to improve reliability.

According to a first aspect of the invention, there is provided a substrate, having a light emitter, which is used for an image display device, the substrate comprising:

(A) a substrate which has a member having a plurality of openings on a surface of the substrate;

(B) light emitters which are arranged in the plurality of openings respectively;

(C) a plurality of conductive films arranged to cover the light emitter; and (D) an electrode pad which is connected to a power supply for providing potential to the plurality of conductive film, wherein the member having the plurality of openings has a conductive area, the conductive area is electrically connected to the electrode pad, each of the plurality of conductive films is in contact with the member having the plurality of openings, the minimum value of resistances ($R_x$) between the two conductive films adjacent to each other in the plurality of conductive films is larger than the minimum value of resistances ($R_z$) between the conductive area and the plurality of conductive films, and a resistance ($R_p$) in a range from the conductive area to the, electrode pad is smaller than the resistance ($R_z$) in a range from the conductive area to each of the plurality of conductive films.

According to a second aspect of the invention, there is provided a substrate, having a light emitter, which is used for an image display device, the substrate comprising:

(A) a substrate which has a resistance member including a plurality of openings on a surface of the substrate;

(B) light emitters which are arranged in the plurality of openings respectively;

(C) a plurality of conductive films which are arranged so as to be connected to the resistance member, the light emitter arranged inside each of the plurality of openings being covered with the conductive film, the conductive films being separated from each other at an interval; and (D) an electrically conductive area being connected to the plurality of conductive films electrically through the resistance member, wherein the minimum value of resistances ($R_x$) between the two conductive films adjacent to each other in the plurality of conductive films is higher than the minimum value of resistances ($R_z$) between the conductive area and the plurality of conductive films.

A third aspect of the invention is an image display device including the substrate having the light emitter described in the first aspect or the second aspect of the invention and the rear plate in which electron-emitting devices are arranged.

In the invention, when resistance $R_x$ is simply measured between two adjacent conductive films in the plurality of conductive films, the resistance $R_x$ cannot accurately be measured because wrap-around of resistance $R_z$through the conductive area is added to the resistance $R_x$. As used herein, the term of "resistance $R_x$" between the two adjacent conductive films in the plurality of conductive films shall mean the resistance $R_x$ in which the wrap-around of the resistance $R_z$ is removed.

The function of restricting the current during the discharge is imparted to the faceplate of the invention. Therefore, the image display device in which the damage is suppressed during the discharge to improve the reliability can be obtained by using the face plate of the invention.

DETAILED DESCRIPTION OF THE PREFERRED EMBODIMENTS

When the discharge is generated between the faceplate 40 and the rear plate 31 as described above, in order to decrease discharge current so that the effect of the discharge is suppressed, it is effective that the charge accumulated in the electrostatic capacity is prevented from flowing into the rear plate 31.

A basic principle of the substrate having a light emitter (sometimes referred to as "faceplate") of the invention will be described.

Figure 1A:
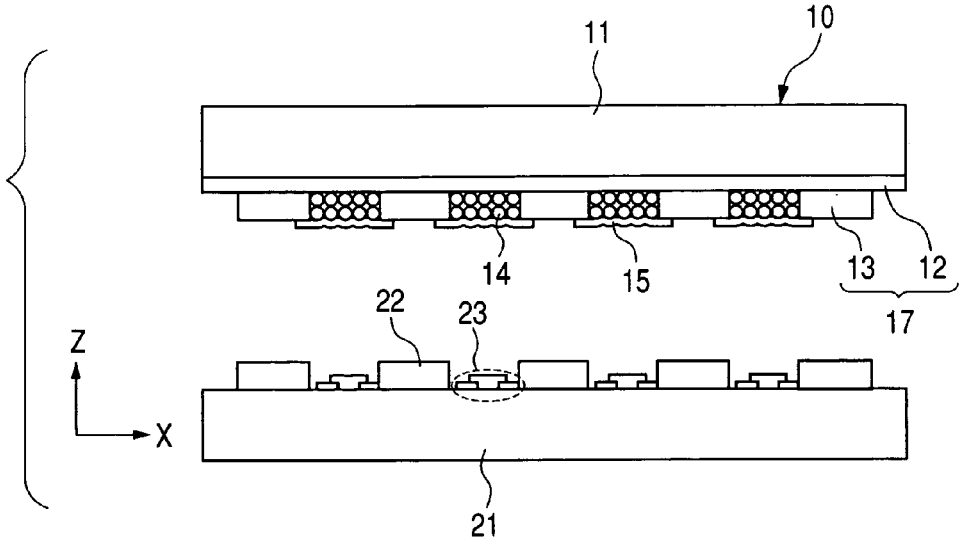
FIGS. 1A and 1B are schematic views showing a structure of an embodiment of an image display device according to the invention.
Figure 1B:
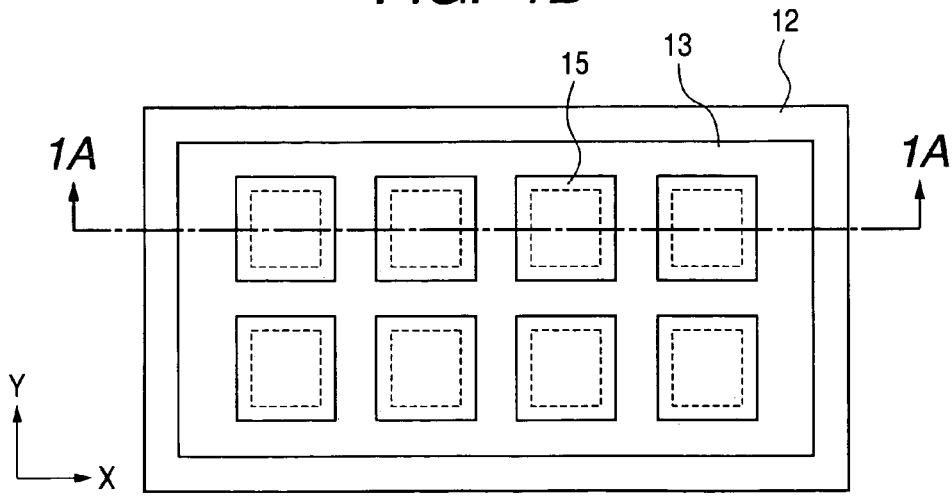

FIGS. 1A and 1B schematically show a structure of a display panel according to an embodiment of the image display device to which the substrate having the light emitter of the invention is applied. FIG. 1A is a sectional view, and FIG. 1B is a plan view showing a faceplate 10 when viewed from the side of a rear plate 21. FIG. 1A and FIG. 1B are sectional views taken of line 1A-1A. In FIGS. 1A and 1B, the numeral 10 represents the faceplate (light emitter substrate), the numeral 11 represents a substrate, the numeral 12 represents a conductive area, the numeral 13 represents a distance specifying member, the numeral 14 represents a light emitter, the numeral 15 represents a conductive film, the numeral 17 represents a light emitter layer, the numeral 21 represents the rear plate, the numeral 22 represents a row-direction wiring, and the numeral 23 represents an electron emitting device.

In the image display device according to the invention, the metal back performs functions of increasing efficiency of light emission outputted to the side of the substrate 11 by reflecting forward the light emitted to the side of the rear plate 21 or applying the accelerating voltage in order to accelerate the electron.

In the invention, the metal back is formed by the plurality of conductive films 15, and the respective conductive films 15 are preferably formed in a rectangle or a square. A potential of each conductive film 15 is defined by electrically connecting the conductive film 15 to the conductive area 12. The conductive area 12 may constitute the member 17 according to the invention, and the member 17 has a plurality of openings (hereinafter referred to as "opening member"). The opening member 17 may have the distance specifying member 13 and the conductive area 12. The distance specifying member 13 specifies (defines) the distance between the light emitters 14 (fluorescent material). Therefore, in the manufacturing process, it is possible to adopt the process of arranging the light emitter 14 in each opening after the opening member 17 is formed.

The shape of the conductive area 12 constituting a part of the opening member 17 is not limited only to the configuration shown in FIGS. 1A and 1B. For example, as shown in FIGS. 1A, 10B and 10C, it is possible to form the configuration in which a metal plate having openings (such as a lattice-shaped metal plate) 27 is covered with a high-resistance member 28. Further, it is also possible that the conductive area 12 has the configuration in which the conductive area 12 is connected to an electrode pad to which the later-mentioned anode potential is provided. Accordingly, the opening member 17 is one which has a concave portion or a through-hole in which the light emitter 14 is stored.

The plurality of electron-emitting devices 23 and the wirings connected to the electron-emitting devices 23 are arranged on the rear plate 21 (only the row-direction wirings 22 are shown in FIGS. 1A and 1B). As described in the related art, the plurality of electron-emitting devices 23 can be arrayed in the matrix shape. The field emission type electron-emitting device and the surface conduction electron-emitting device can be used as the electron-emitting device 23. For example, an MIM type electron-emitting device, the field emission type electron-emitting device in which carbon nanotube or carbon fiber is used, and the electron-emitting device in which a ballistic electron-emitting phenomenon from a porous polysilicon layer is applied can be used as the field emission type electron-emitting device.

Figure 2A:
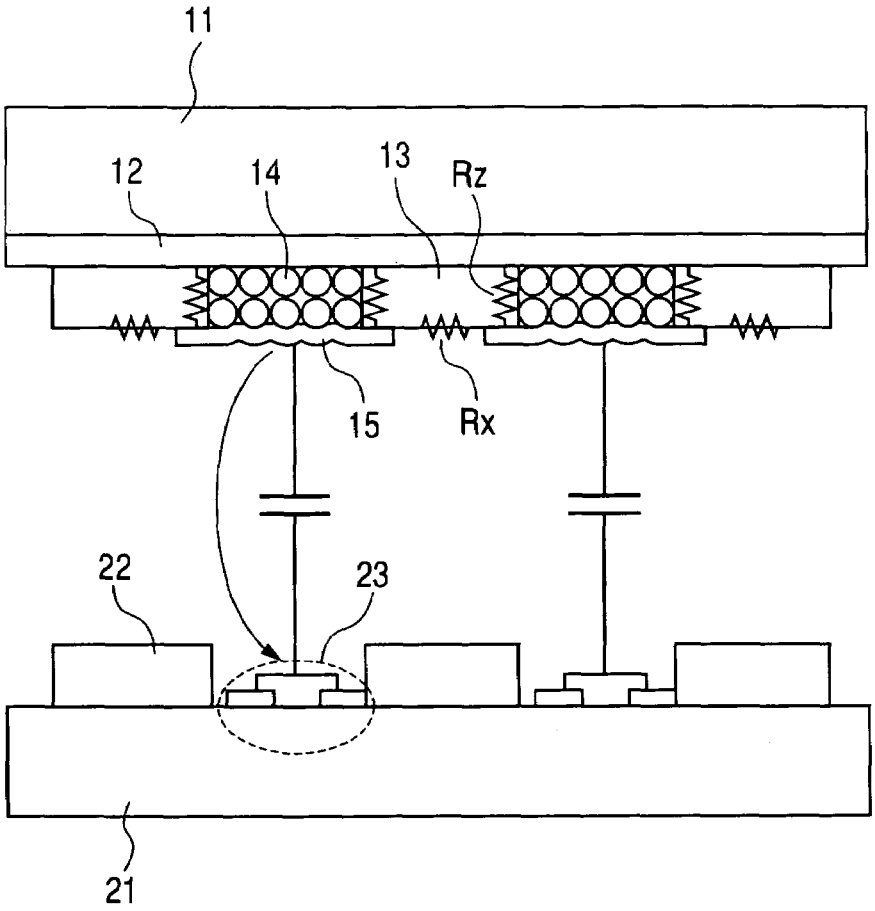
FIGS. 2A and 2B show characteristics when the image display device of FIGS. 1A and 1B discharges.
Figure 2B:
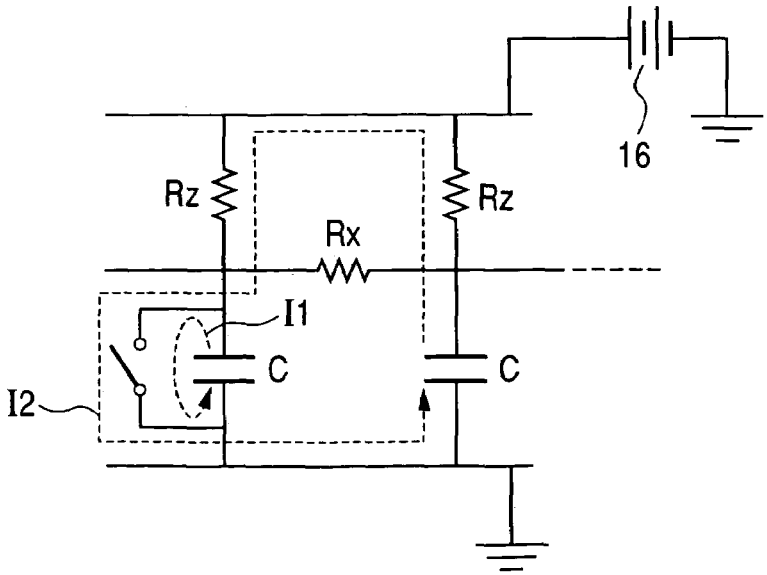

FIGS. 2A and 2B are views in which the state, in which the discharge is generated in the display panel of FIGS. 1A and 1B, is substituted for an electric circuit. FIG. 2A is a view in which the state of the discharge is added to the structure of the image display device, and FIG. 2B shows an equivalent circuit of the state in which the discharge is generated between the arbitrary conductive film 15 and the conductive member on the rear plate 21 (for example, electron-emitting device 23 or wiring 22).

In the invention, as shown in FIGS. 1A and 1B, the metal back is divided into the plurality of conductive films 15. Therefore, when the discharge is generated in an arbitrary block based on a unit of the conductive film 15 (when the discharge is generated between the arbitrary conductive film 15 and the conductive member on the rear plate 21), the charge accumulated in the block (conductive film 15) flows directly into the rear plate 21 (corresponding to I1 of FIG. 2B).

However, the currents (corresponding to I2 of FIG. 2B) flow into the block from other blocks (other conductive films 15) through the distance specifying member 13 and the conductive area 12, and the currents are suppressed by the resistance (in the structure of FIGS. 1A and 1B, the resistance in a film-thickness direction of the distance specifying member 13) $R_z$between conductive film 15 and the conductive area 12. This effect can be obtained by increasing the resistance (in the structure of FIGS. 1A and 1B, the resistance in a plane direction of the distance specifying member 13) $R_x$ between the adjacent blocks (between the conductive films 15) larger than the resistance $R_z$.

When the resistance $R_x$ is smaller than the resistance $R_z$, the current flowing through the resistance $R_x$ becomes larger than the current flowing through the resistance $R_z$, and the effect of the resistance $R_z$ is decreased. Therefore, in the structure of FIGS. 1A and 1B, the resistance in the film-thickness direction of the distance specifying member 13 is formed so as to be smaller than the resistance in the film-thickness direction of the light emitter 14, and the resistance in the plane direction of the distance specifying member 13 (the resistance between the adjacent conductive films 15 in a direction substantially perpendicular to the film-thickness direction of the distance specifying member 13) is formed so as to be larger than the resistance in the film-thickness direction of the distance specifying member 13. Thus, the distance specifying member 13 has the function as the resistor, so that the distance specifying member 13 can be reworded as "resistance member including the plurality of openings" in the invention.

Preferably the light emitter 14 is formed by a member (insulating material) having a sufficiently high resistance value. Further, preferably the light emitter 14 is formed by a plurality of insulating fluorescent material particles.

In the resistance $R_x$ between the adjacent blocks (between the conductive films 15), the wrap-around by the resistance $R_z$ is removed. However, when the resistance is simply measured between the conductive films 15, the wrap-around by the resistance $R_z$ cannot be removed. Therefore, an example of a method of measuring the resistances $R_x$ and $R_z$ according to the invention will be described referring to FIG. 3.

Figure 3:
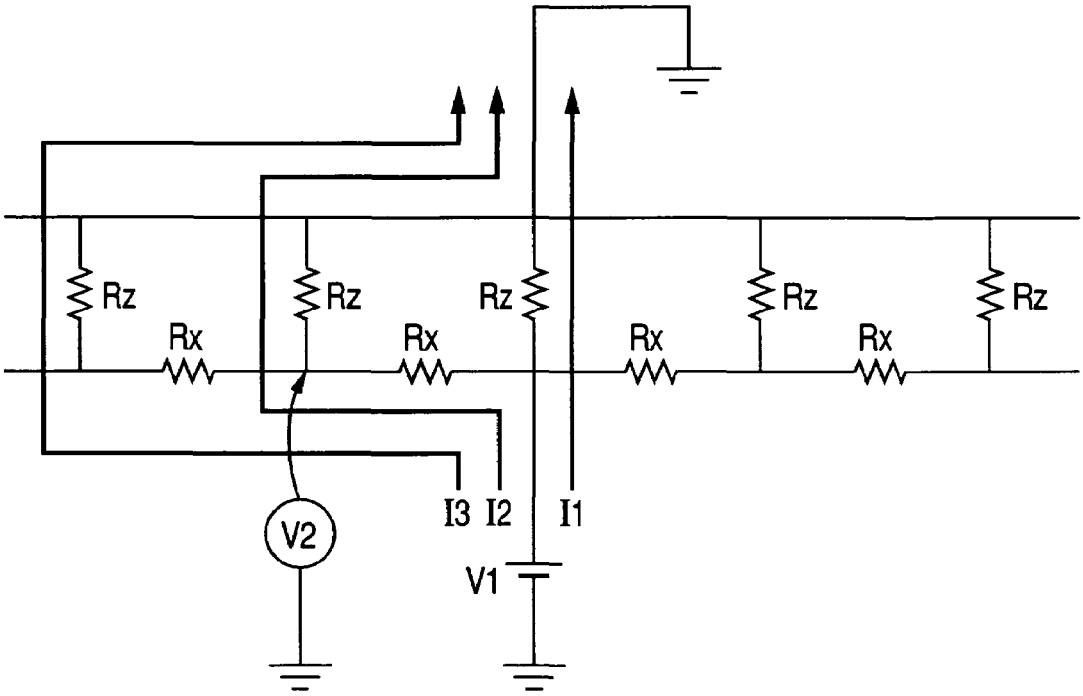
FIG. 3 is an equivalent circuit showing a method of measuring a resistance ratio of a light emitter substrate according to the invention.

FIG. 3 shows the equivalent circuit of the state in which the resistances $R_x$ and $R_z$ are measured in the faceplate 10 shown in FIGS. 1A and 1B. In the structure of FIGS. 1A and 1B, the resistance $R_z$ between the conductive film. 15 and the conductive area 12 corresponds to the resistance in the film-thickness direction of the distance specifying member 13, and the resistance $R_x$ between the adjacent conductive films 15 corresponds to the resistance in the plane direction of the distance specifying member 13.

It is assumed that the resistance between the arbitrary conductive film 15 and the conductive film 15 adjacent to the arbitrary conductive film 15 is $R_x$ (the resistance in the plane direction of the distance specifying member 13 in FIGS. 1A and 1B) and the resistance in the range from the arbitrary conductive film 15 to the conductive area 12 through the distance specifying member 13 is $R_z$ (the resistance in the film-thickness direction of the distance specifying member 13 in FIGS. 1A and 1B). Then, as shown in FIG. 3, a voltage power supply generating voltage V1 is connected to the arbitrary conductive film 15, and the conductive area 12 is set to GND potential. Voltage V2 at the conductive film 15 adjacent to the conductive film 15 connected to the voltage power supply is measured to compare the voltage V2 to the voltage V1. It is simplistically thought that the current flowing from the voltage power supply to GND has two paths, i.e. the path of I1 in which the current flowing around the resistance $R_z$ and the path of I2 in which the current flowing around the resistance $R_x$ in FIG. 3. When the resistance $R_x$ is larger than the resistance $R_z$, the current I2 flows to cause the voltage drop at the resistance $R_x$ to be larger than the voltage drop at the resistance $R_z$, so that the voltage V2 becomes lower than a half of the voltage of V1. Even in consideration of the wrap-around of the currents which flow the path of I3 and farther paths, the voltage drop at the resistance $R_x$ located in the current path I2 becomes $(I2+I3)\times R_x$ and,the voltage drop at the resistance $R_x$ is smaller than the voltage drop $I2\times R_z$ at the resistance $R_z$, so that the voltage V2 becomes lower than the half of the voltage of V1. Thus, whether the resistance $R_x$ is larger than the resistance $R_z$ or not can be decided. In order to measure more accurately the resistance $R_x$, there is the method of measuring the resistance $R_x$ using the faceplate in which the conductive area 12 is not produced as an $R_x$ measurement faceplate. The resistances $R_x$ and $R_z$ having the configuration described above are formed in each conductive film provided on the face plate according to the number of pixels or the number of sub-pixels. In order to obtain the effect of the invention, in any pixel or sub-pixel, it is necessary to satisfy the above-described relationship between the resistances, so that the resistances are compared to each other in the minimum values. The above-described relationship between the resistances can similarly be applied to the following resistances $R_x$ and $R_z$.

The following conditions are required for the resistance $R_z$.

(1) The resistance $R_z$ is such that current restriction during the discharge is sufficiently exhibited.

(2) The resistance $R_z$ is such that the voltage drop is not substantially generated by the current injected from the electron-emitting device for the purpose of the image display.

With reference to (1), although the resistance $R_z$ depends on the accelerating voltage applied to the image display device or the size of the display area, it is preferable that an effect of the current restriction is exhibited when the resistance $R_z$ is more than 500Ω, and it is more preferable that the resistance is not lower than 5 KΩ. With reference to (2), although the resistance $R_z$ depends on the amount of current injected from the electron-emitting device, the voltage drop caused by the current injected from the electron-emitting device becomes sufficiently small when the resistance $R_z$ is lower than 1 MΩ, and more preferably the voltage drop can substantially be neglected when the resistance $R_z$ is not more than 100 KΩ.

With reference to (1), when the resistance $R_x$ is lower than 1 KΩ, the current flowing through the resistance $R_x$ becomes large. Therefore, although the resistance $R_x$ depends on the accelerating voltage applied to the image display device or the size of the display area, the resistance $R_x$ is set to not lower than 1 KΩ to exhibit a current restriction. More preferably, the resistance $R_x$ is set to 1 MΩ or more, for practical use.

For the method of connecting each conductive film 15 and the conductive area 12 or the high-voltage power supply 16 by-the resistance described above, the method in which the connection is performed not through the opening member 17 according to the invention but through the conductive fluorescent material may be used. However, almost all of the fluorescent materials which emit the light by the electron beam irradiation are the insulating material, and light-emission color and light-emission efficiency are sacrificed when the conductivity is imparted to the fluorescent material. On the contrary, when the structure in which the resistance $R_z$ is determined by the member (opening member 17) except for the fluorescent material is formed like the invention, the light-emission color and the light-emission efficiency which are of the important functions of the image display device are not sacrificed.

Any configuration can be adopted for the conductive area 12 according to the invention, because the conductive area 12 electrically connects the electrode pad (not shown) and each conductive film 15. Preferably the conductive film 15 is formed on the surface side of the substrate 11 of the opening member 17, and the desired effect can be obtained without obstructing the light emitted from the fluorescent material (light emitter) 14 by producing the conductive film transparent to visible light over the surface of the substrate 11 specifically by producing the transparent conductive film such as ITO over the surface of the substrate 11.

The structure in which the distance specifying member 13 is clearly distinguished from the conductive film 12 is shown in FIGS. 1A and 1B. However, as long as the requirement for the resistances $R_x$ and $R_z$ are satisfied, it is also possible to form the structure in which the distance specifying member 13 cannot clearly be distinguished from the conductive film 12 by means for continuously changing composition of the opening member 17 to control the resistance. Therefore, it is understood that the conductive area 12 is the area which exhibits the lowest resistance in the plane direction (direction parallel to the surface of the substrate 11 of the faceplate 10) of the opening member 17. However, the conductive area 12 is never located on the outermost surface (surface which is in contact with the conductive film 15) of the opening member 17.

For example, the conventional black matrix can be applied to the distance specifying member 13 according to the invention. Examples of the method of manufacturing the distance specifying member 13 includes a photolithography method and a screen printing method in which ruthenium oxide paste, resistance element paste containing carbon graphite, glass frit, and back pigments, or paste containing barium titanate powder is used. The materials except for the above-described materials can be used as long as the material has the high resistance value.

The electrode pad (not shown) also acts as the member which electrically connects the conductive area 12 and the high-voltage power supply 16 for providing the anode potential. When the resistance $R_p$ in the range from the conductive area 12 located nearest each conductive film 15 to the electrode pad (position to which the anode potential is provided) is larger than the resistance $R_z$ in the range from each conductive film 15 to the conductive area 12, the potentials of the conductive films 15 are varied by the influence of the current due to the electron beam. When the resistance $R_p$ is smaller than the resistance $R_z$, the potentials may become substantially equal among arbitrary points of the conductive area 12. As a result, the potentials of the conductive films 15 may be also substantially equalized.

As the size of each conductive film 15 is decreased, the charge accumulated in each conductive film 15 is decreased. As a result, since the current (corresponding to I1 in the drawings) flowing into the block by the discharge becomes small, it is preferable in displaying the stable image.

In the faceplate 10, the fluorescent material (light emitter) 14 which emits the light of any one of R (Red), G (Green), and B (Blue) is arranged to form one sub-pixel. A set of three sub-pixels of R, G, and B may form one pixel. Accordingly, it is possible that one sub-pixel is covered with the conductive film 15, it is possible that one pixel is covered with the conductive film 15, and it is possible that at least two pixels are covered with the conductive film 15.

Figure 13:
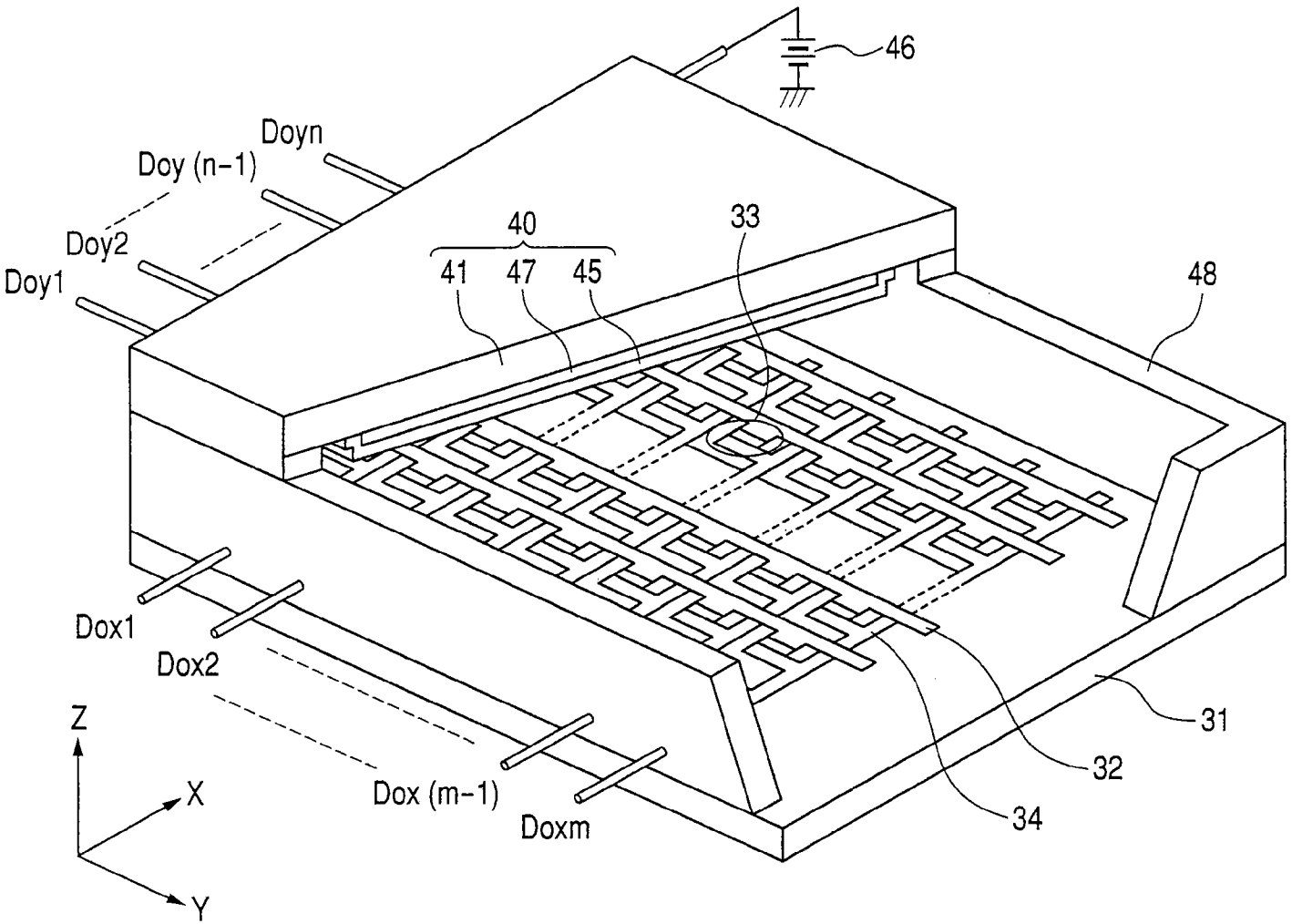
FIG. 13 (PRIOR ART)
FIG. 13 is a perspective view showing a structure of a display panel of an example of the conventional image display device.
Figure 14:
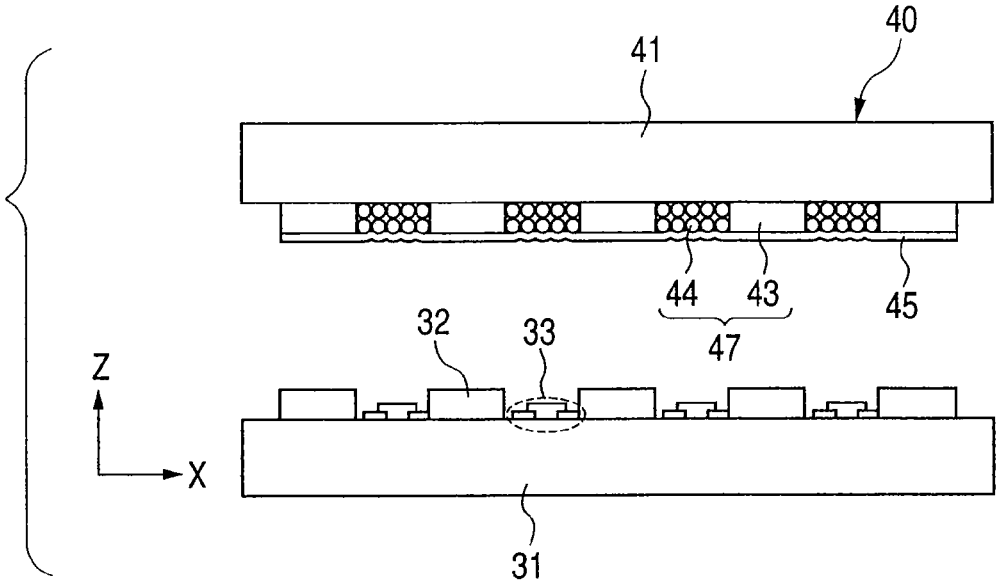
FIG. 14 (PRIOR ART)
FIG. 14 is a schematic sectional view of the display panel of FIG. 13.

The image display device of the invention is formed by the substrate having a light emitter of the invention and an electron-emitting device. Accordingly, except that the substrate with a light emitter of the invention is used as the faceplate 40 of the display panel of FIG. 13, the convention configuration can be applied to other configurations as it is.

Figure 4:
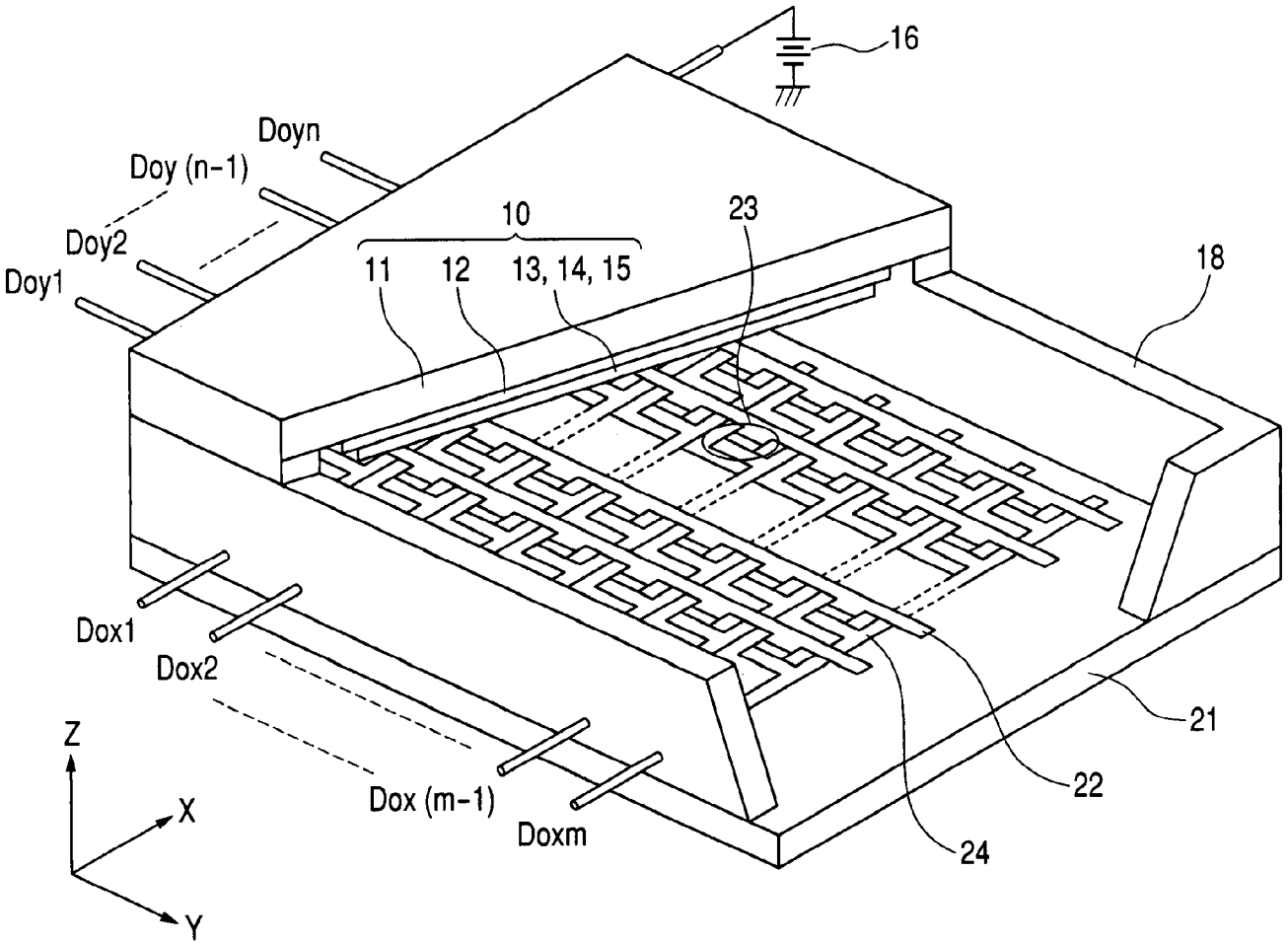
FIG. 4 is a perspective view showing a structure of a display panel of an embodiment of an image display device according to the invention.

FIG. 4 shows a schematic structure of an image display device (display panel) according to an embodiment of the invention. In FIG. 4, the numeral 16 represents a high-voltage power supply, the numeral 18 represents a sidewall, and the numeral 24 represent a column-direction wiring. The same member as FIGS. 1A and 1B are indicated by the same numeral. The high-voltage power supply provides the voltage ranging from 1 KV to 30 KV to the anode.

An information displaying/reproducing(playback) apparatus can be formed by using the display panel (image display device) of the invention, which is described referring to FIG. 4.

Specifically, the information displaying/reproducing apparatus such as a television set includes a receiving apparatus which receives a broadcasting signal such as a television broadcasting signal, a tuner which selects the received signals, and displaying and/or reproducing apparatus which outputs at least one of video information, character information, and audio information which are included in the selected signal to the display panel to display it on the screen. When the broadcasting signal is encoded, the information displaying/reproducing apparatus of the invention can include a decoder. An audio signal is outputted to separately-provided sound reproducing means such as a speaker to reproduce the audio signal in synchronization with the video information or the character information which is displayed on the display panel. The face plate (11,15,17) may correspond to the screen.

The following method can be cited as an example of the method of outputting the video information or the character information on the display panel to display and/or reproduce the video information or the character information on the screen. An image signal is generated corresponding to each pixel of the display panel from the received video information or character information. The generated image signal is inputted to a drive circuit of a display panel 77. Then, the image is displayed by controlling the voltage applied to each electron-emitting device in the display panel on the basis of the image signal inputted to the drive circuit.

Figure 15:
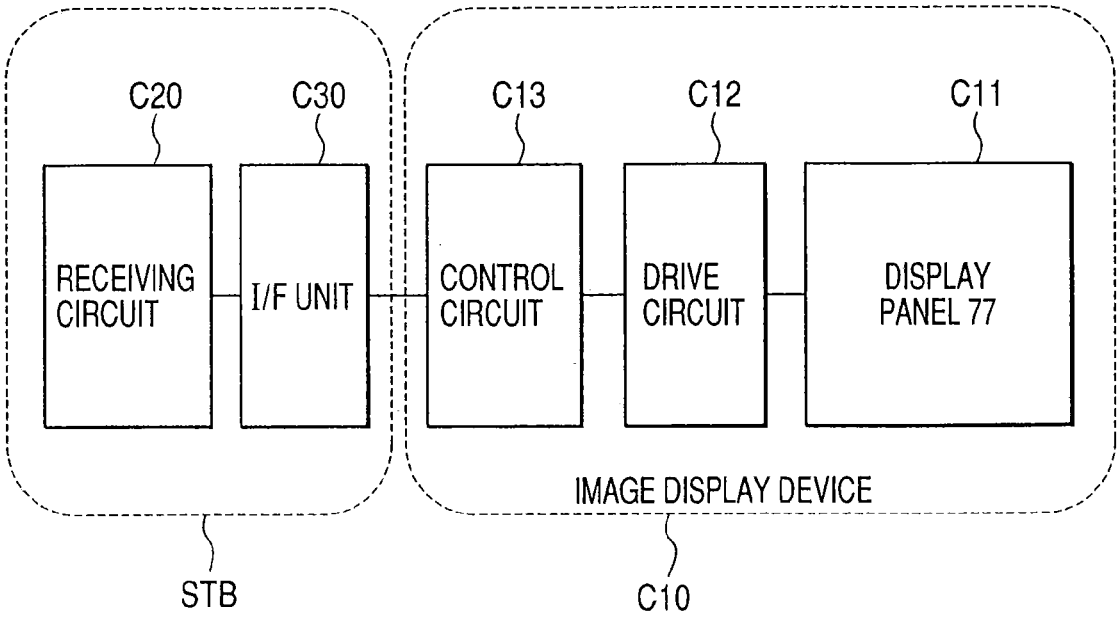
FIG. 15 is a block diagram of a television set according to the invention.

FIG. 15 is a block diagram of the television set according to the invention. A receiving circuit includes the tuner and the decoder. The receiving circuit receives a television signal of satellite broadcasting, a ground wave, or the like or data broadcasting through a network, and the receiving circuit outputs the decoded video data to an interface unit. The interface unit converts the video data into a display format of the display device to output the image data to the display panel 77. The image display device includes the display panel 77, a drive circuit, and a control circuit. The control circuit outputs the image data and various control signals to the drive circuit while performing image processing, such as correction processing suitable to the display panel, to the inputted image data. The drive circuit outputs a drive signal to each of wirings (see Dox1 to Doxm and Doy1 to Doyn) of the display panel 77 on the basis of the inputted image data, and a television picture is displayed. It is possible that the receiving circuit and the interface unit are housed in a chassis as a set top box (STB) different from the image display device, or it is possible that he receiving circuit and the interface unit are housed in the same chassis as the image display device.

It is possible that the interface unit is connected to an image recording apparatus and image output apparatus such as a printer, a digital video camera, digital camera, a hard disk drive (HDD), and a digital video disk (DVD). In this case, it is possible to form the information display reproducing apparatus (or television set) in which the image recorded in the image recording apparatus can also be displayed on the display panel 77 and the image displayed on the display panel 77 is processed according to need to output the processed image to the image output apparatus.

The configuration of the information display reproducing apparatus described above is only for illustrative purpose, and various modifications and changes can be made on the basis of the technical thought of the invention. The information display reproducing apparatus of the invention can form the various information display reproducing apparatuses by connecting the information display reproducing apparatus to a system such as a television meeting system and a computer.

EXAMPLES

Referring to the accompanying drawings, examples of the invention will be described. However, the scope of the invention shall not be limited to the size, the material, and the shape of the constituent components and a relative arrangement of the components which are described in the following examples except for the particular description.

Example 1

The image display device including the display panel shown in FIGS. 1A and 4 was produced.

In Example 1, the distance between the rear plate 21 and the faceplate 10 was set to 2 mm. The inside of the sealed vessel formed by the rear plate 21, the faceplate 10, and the sidewall 19 was maintained at a degree of pressure below $10^{-7}$ Pa. In Example 1, the number of row-direction electric line 22 was set to 240 (N=240), and the number of column-direction electric line 24 was set to 80 (M=80).

Figure 5A:
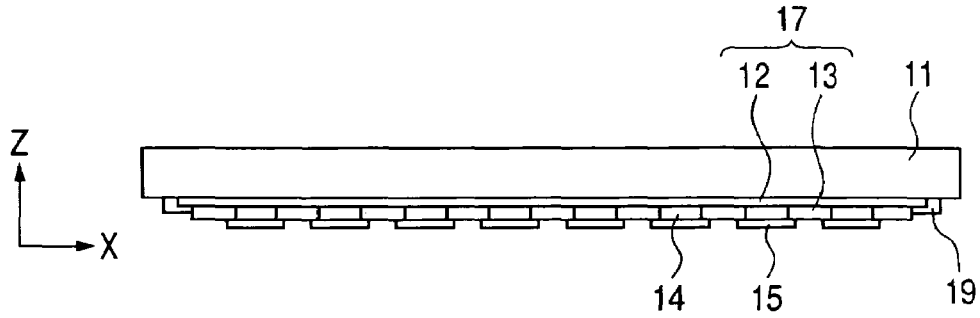
FIGS. 5A and 5B are schematic views showing a structure of a faceplate according to Example 1 of the invention.
Figure 5B:
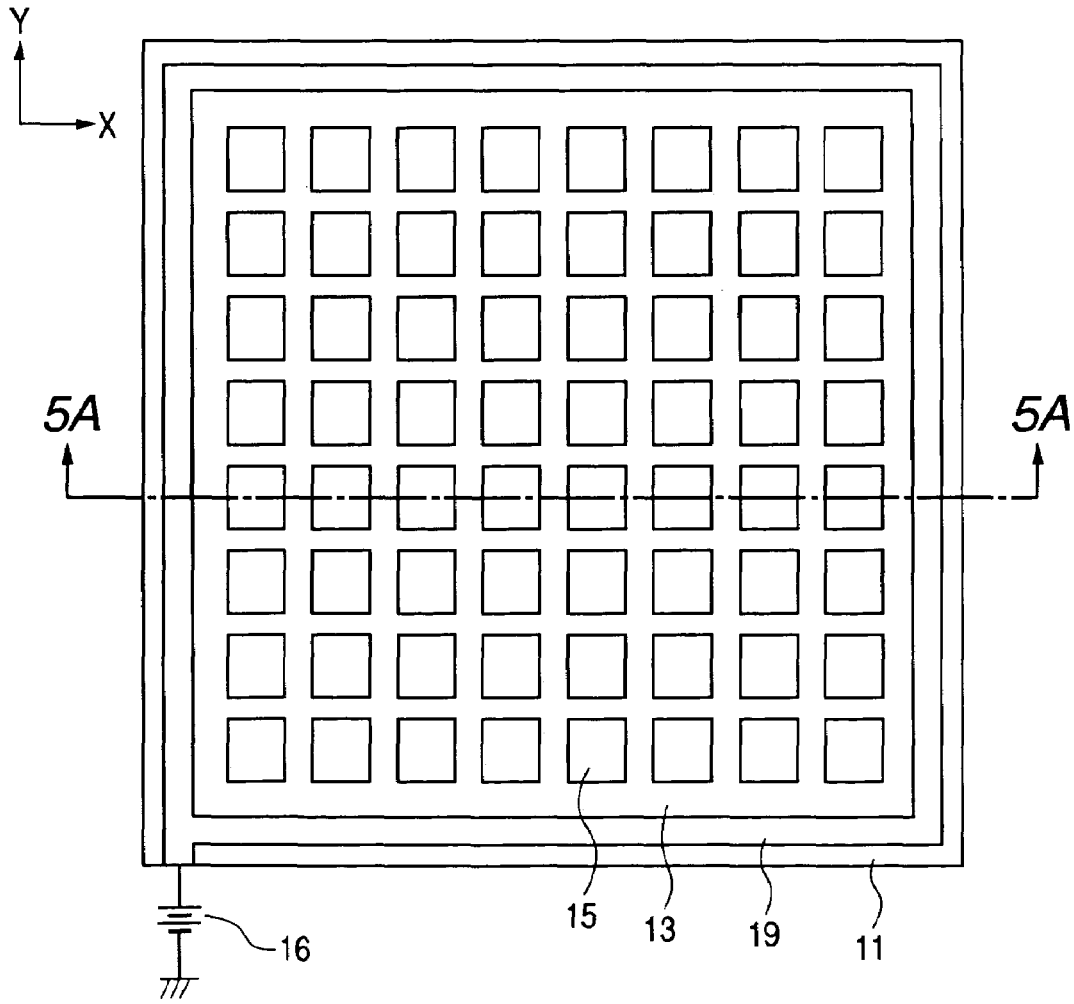

FIGS. 5A and 5B show the structure of the faceplate in Example 1. FIG. 5A is a schematic sectional view taken on dashed line of FIG. 5B, and FIG. 5B is a plan view when the faceplate is viewed from the rear plate side.

The process of manufacturing the faceplate of Example 1 will specifically be described below.

ITO which formed the conductive area 12 was deposited over the surface of the image area of the cleaned glass substrate by a sputtering method. A sheet resistance value of ITO was set to 100 Ω□.

Then, the paste containing silver particles and glass frits was printed around the conductive area 12 as shown in FIGS. 5A and 5B by the screen printing method, and the printed paste was baked at 400° C. to form an electrode pad 19. A width of the electrode pad 19 was set to 2 mm, and the electrical connection between electrode pad 19 and the conductive area 12 was secured by forming the electrode pad 19 so that the electrode pad 19 overlaps ITO, i.e., the conductive area 12. As schematically shown in FIGS. 5A and 5B, a part of the electrode pad 19 is connected to the high-voltage power supply 16, and the high-voltage potential was provided to the electrode pad 19. When the resistance of the electrode pad 19 was measured, the resistance was not more than 1Ω between the portion connected to the high-voltage power supply and its diagonal portion.

The lattice-shaped black matrix having the openings of 200 μm by 200 μm was formed as the distance. specifying member 13 by the screen printing method with the ruthenium oxide paste. In the black matrix, the thickness was 10 μm, and a pitch of the opening was 250 μm.

Each opening of the black matrix was filled with the fluorescent materials of R, G, and B by the screen printing method so that the thickness of the fluorescent materials became 10 μm. The fluorescent materials were printed in each color. In Example 1, the opening was filled with the fluorescent materials by the screen printing method. However, the filling method is not limited to the screen printing method. For example, it is possible to adopt the photolithography method. The fluorescent material of P22 which is used in the CRT field was used as the fluorescent material 14. The red color (P22-RE3; $Y_2O_2S:Eu^{3+}$), the blue color (P22-B2; ZnS:Ag,Al), and the green color (P22-GN4; ZnS:Cu,Al) were used as the fluorescent materials.

A resin film was deposited on the black matrix and the fluorescent material by a filming process which is publicly known as the manufacturing technology of a cathode-ray tube. Then, Al was deposited on the resin film by the evaporation. The resin film was removed by thermal decomposition to produce the conductive film (Al film) whose thickness was 100 nm on the black matrix and the fluorescent material.

The conductive film was cut on the black matrix with a YAG laser machine to divide the conductive film into the conductive films 15 of each sub-pixel. Thus, the black matrix and the conductive film 15 were connected to each other by overlapping each other in the region whose width was 25 μm, and the adjacent conductive films 15 were separated from each other by the distance of 200 μm.

Then, the faceplates for measuring the resistances $R_x$ and $R_z$ were produced. In the faceplate for measuring the resistance $R_z$, the conductive film of the faceplate produced in the above-described way was removed except for the measurement area. In the faceplate for measuring the resistance $R_x$, ITO which is of the conductive area was produced, and the conductive film was removed except for the set of adjacent conductive films 15 in the measurement area. As a result of the measurement with the measurement faceplates, the resistance $R_z$ was 1.5 KΩ and the resistances $R_x$ was 200 KΩ. The resistance $R_p$ was measured in the faceplate which was completed to the stage of forming the electrode pad 19 in the above-described way. When the resistances $R_p$ were measured at many points in the image display area, the maximum value of the resistances $R_p$ was about 30Ω. When the magnitudes of the resistances $R_x$ and $R_z$ were compared to each other by the method shown in FIG. 3, the resistance $R_x$ was larger than the resistance $R_z$.

The faceplate of Example 1 was used to produce the image display device which included the display panel having the structure shown in FIGS. 1A and 4. When the high voltage of 15 KV was used as the anode potential, sometimes the discharge was generated. However, the defect that an observer perceived was not generated, and the stable image display device having the high reliability was obtained.

In Example 1, the image display device having the high brightness and good color reproducibility could be obtained by using the P22 fluorescent materials (insulating material) which have a reputation in the CRT field.

Example 2

Figure 6A:
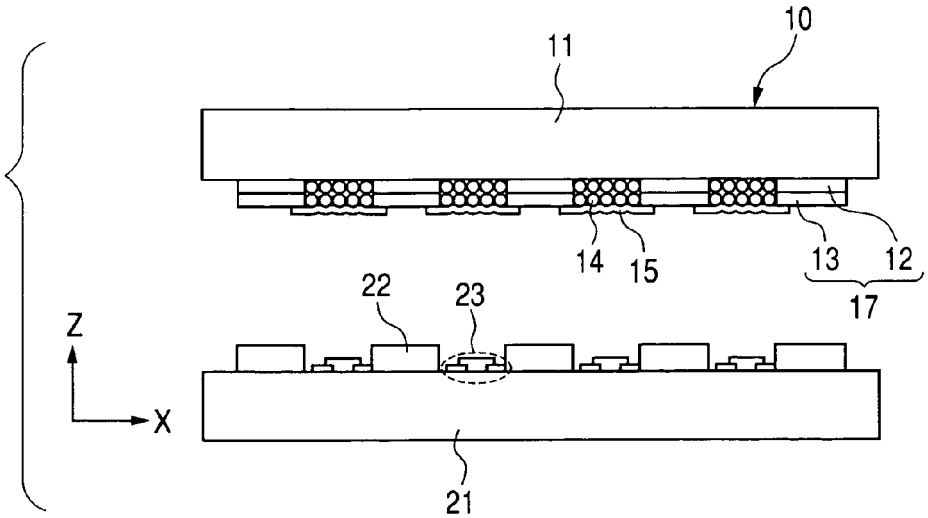
FIGS. 6A, 6B and 6C are schematic views showing a structure according to Example 2 of the invention.
Figure 6B:
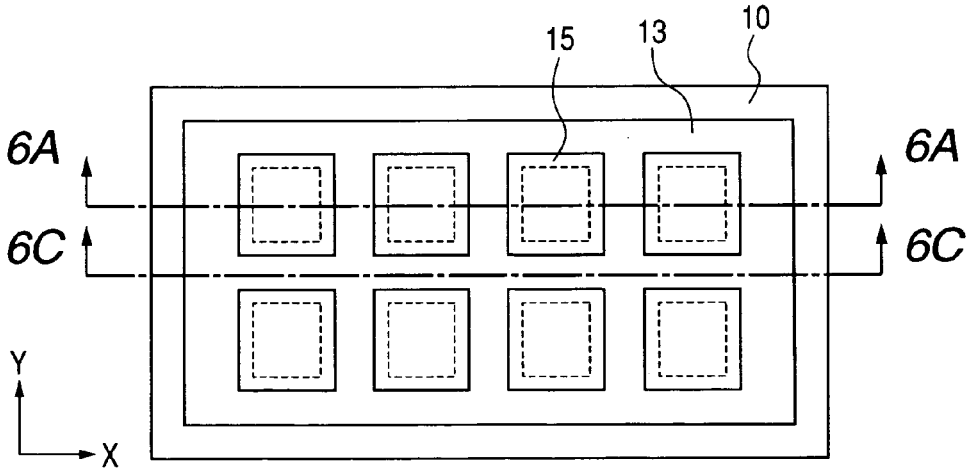
Figure 6C:
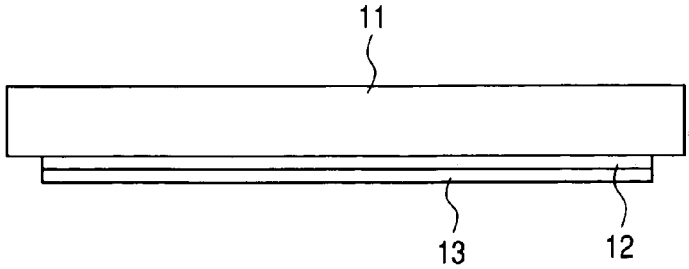

The image display device including the display panel shown in FIG. 6A was produced. FIG. 6B is a plan view when the faceplate 10 is viewed from the side of the rear plate 21, FIG. 6A is a sectional view taken on line 6A-6A of FIG. 6B, and FIG. 6C is a sectional view taken on line 6C-6C of FIG. 6B.

In Example 2, the conductive area 12 was formed between the substrate 11 and the distance specifying member 13 while the pattern of the conductive area 12 was equal to that of the distance specifying member 13. Specifically, the conductive area 12 was formed so that the thickness of the paste containing the black pigments, silver particles, and the frit glass became 5 μm by the screen printing method using the glass substrate similar to Example 1. The subsequent processes were similar to Example 1 except that the thickness of the black matrix was set to 5 μm.

When the resistances $R_x$, $R_z$ and $R_p$ were measured in the same way as Example 1, $R_x$ was 100 KΩ, $R_z$ was 700Ω, and $R_p$ was not more than 1Ω. When the magnitudes of the resistances $R_x$ and $R_z$ were compared to each other by the method similar to Example 1 (FIG. 3), the resistance $R_x$ was larger than the resistance $R_z$.

The faceplate of Example 2 was used to produce the image display device which included the display panel having the structure shown in FIG. 6A. When the high voltage of 15 KV was used as the anode potential, sometimes the discharge was generated. However, the defect that the observer perceived was not generated, and the image display device having the high reliability could stably be formed.

In Example 2, since the conductive area 12 does not exist in the portion where the fluorescent material 14 is provided, transmittance of the light is improved, and the brighter image was obtained.

Example 3

Figure 7A:
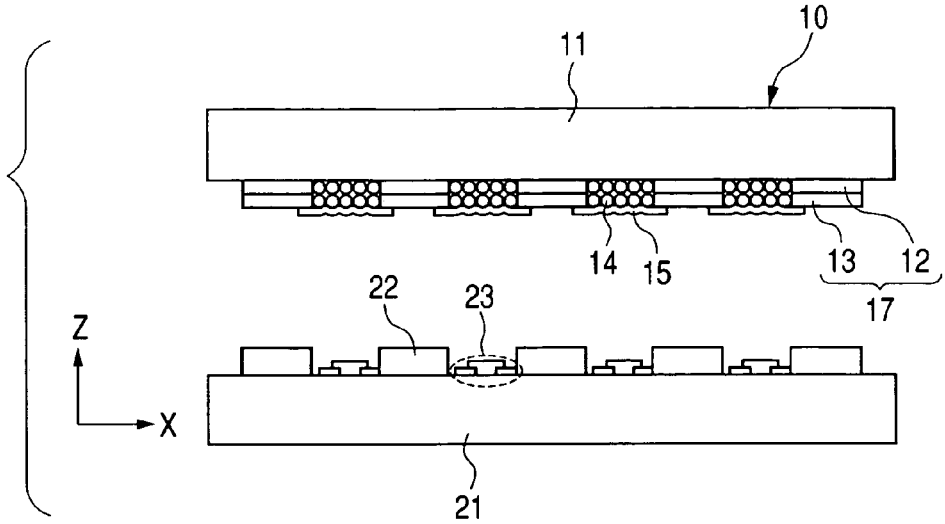
FIGS. 7A, 7B and 7C are schematic views showing a structure according to Example 3 of the invention.
Figure 7B:
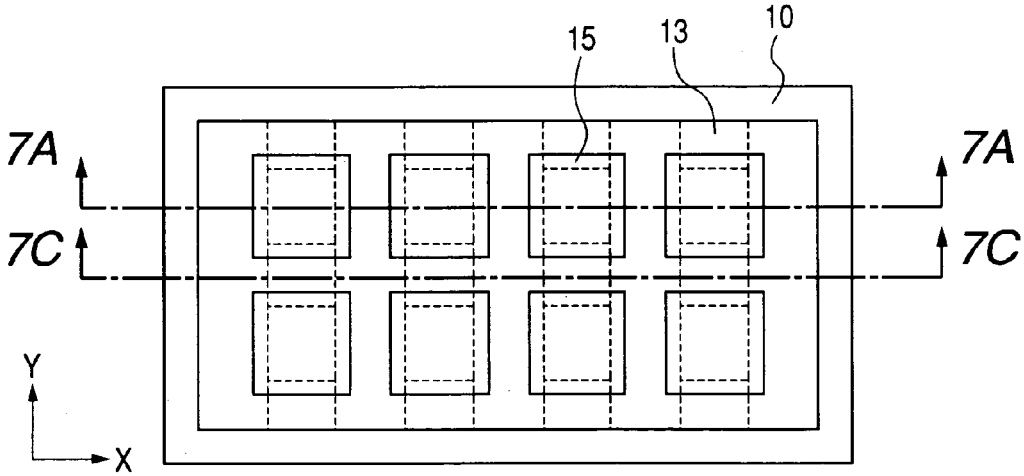
Figure 7C:
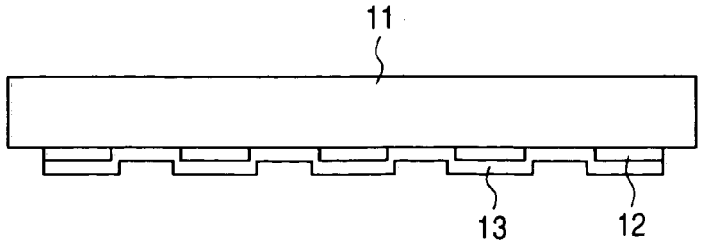

The image display device including the display panel shown in FIG. 7A was produced. FIG. 7B is a plan view when the faceplate 10 is viewed from the side of the rear plate 21, FIG. 7A is a sectional view taken on line 7A-7A of FIG. 7B, and FIG. 7C is a sectional view taken on-line 7C-7C of FIG. 7B.

In Example 3, the conductive area 12 was formed in a line shape parallel to the Y-direction. Specifically, the conductive area 12 was formed so that the thickness of a photosensitive paste containing the black pigments, silver particles, and the frit glass became 2 μm by the screen printing method. Then, the dried photosensitive paste was exposed and developed to produce the plurality of line-shaped conductive areas 12 extending in the Y-direction. The subsequent processes were similar to Example 1 except that the thickness of the black matrix was set to 8 μm.

When the resistances $R_x$, $R_z$ and $R_p$ were measured in the same way as Example 1, $R_x$ was 250 KΩ, $R_z$ was 2 KΩ, and $R_p$ was not more than 1Ω. When the magnitudes of the resistances $R_x$ and $R_z$ were compared to each other by the method similar to Example 1 (FIG. 3), the resistance $R_x$ was larger than the resistance $R_z$.

The faceplate of Example 3 was used to produce the image display device which included the display panel having the structure shown in FIG. 7A. When the high voltage of 13 KV was used as the anode potential, sometimes the discharge was generated. However, the defect that the observer perceived was not generated, and the image display device having the high reliability was obtained.

In Example 3, since the conductive area 12 was formed in the stripe shape, both the resistances $R_x$ and $R_z$ were increased, which allows the current to be decreased during the discharge. Therefore, the image display device which less subjected to the damage caused by the discharge could be formed.

Example 4

Figure 8A:
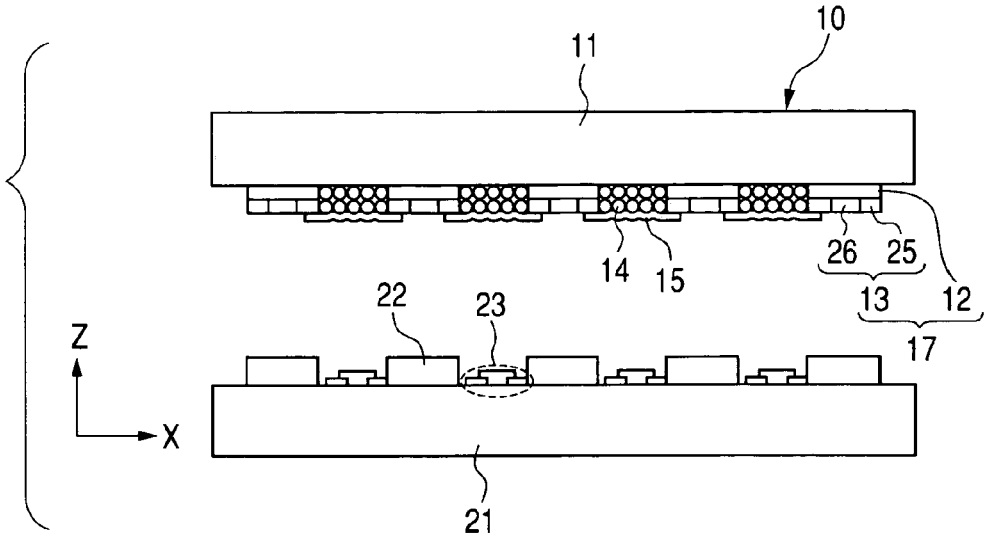
FIGS. 8A, 8B and 8C are schematic views showing a structure according to Example 4 of the invention.
Figure 8B:
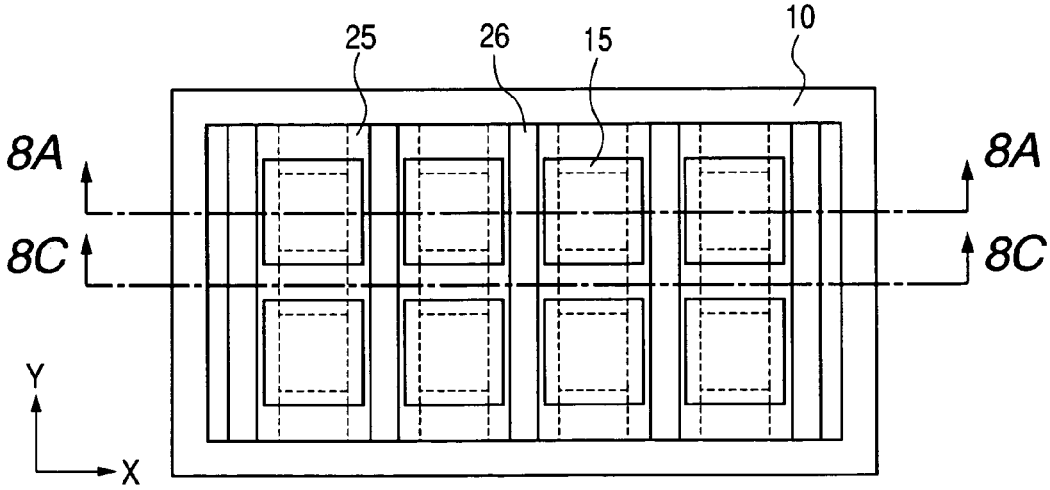
Figure 8C:
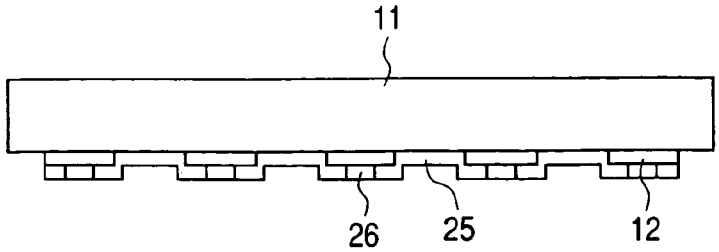

The image display device including the display panel shown in FIG. 8A was produced. In FIG. 8A, the numeral 25 represents a black matrix, and the numeral 26 represents an insulating member. FIG. 8B is a plan view when the faceplate 10 is viewed from the side of the rear plate 21, FIG. 8A is a sectional view taken on line 8A-8A of FIG. 8B, and FIG. 8C is a sectional view taken on line 8C-8C of FIG. 8B.

In Example 4, as with Example 3, the conductive area 12 was formed in the stripe shape parallel to the Y-direction. The distance specifying member 13 was formed by arranging the black matrix 25 and the insulating member 26 on the stripe-shaped conductive area 12. Therefore, the black matrix 25 was in a ladder shape extending in the Y-direction, and the insulating member 26 was formed in a gap between the adjacent ladder-shaped black matrixes 25 while formed in the line shape extending in the Y-direction.

Specifically, the photosensitive paste containing the low-melting glass frit and the black pigments was formed as the insulating member 26 by the photolithography method. In the photosensitive paste, the width was 260 μm and the thickness was 8 μm. The black matrix 25 was also formed by the photolithography method. In the black matrix 25, the width was 20 μm and the thickness was 8 μm.

In Example 4, the insulating member 26 has the function of increasing the resistance $R_x$ between the conductive films 15 divided by the black matrix 25 which is of the resistance element and the resistance $R_z$ between the conductive film 15 and the conductive area 12.

In Example 4, the resistance $R_x$ becomes the resistance through the insulating member 26 by using the insulating member 26, so that the resistance more than 1 MΩ can easily be obtained. Since the area of the black matrix 25 which is of the resistance element which is in contact with the conductive area 12 and the conductive film 15 is decreased, the resistance $R_z$ can be increased.

When the resistances $R_x$, $R_z$ and $R_p$ were measured in the same way as Example 1, $R_x$ was not lower than 10 MΩ, $R_z$ was 20 KΩ, and $R_p$ was not more than 1Ω. When the magnitudes of the resistances $R_x$ and $R_z$ were compared to each other by the method similar to Example 1 (FIG. 3), the resistance $R_x$ was larger than the resistance $R_z$.

The faceplate of Example 4 was used to produce the image display device which included the display panel having the structure shown in FIG. 8A. When the high voltage of 17 KV was used as the anode potential, sometimes the discharge was generated. However, the defect that the observer perceived was not generated, and the image display device having the high reliability could be obtained.

In Example 4, since the insulating member 26 was arranged, both the resistances $R_x$ and $R_z$ were increased, which allows the current to be decreased during the discharge. Therefore, the image display device which less subjected to the damage caused by the discharge could be formed.

Example 5

Figure 9A:
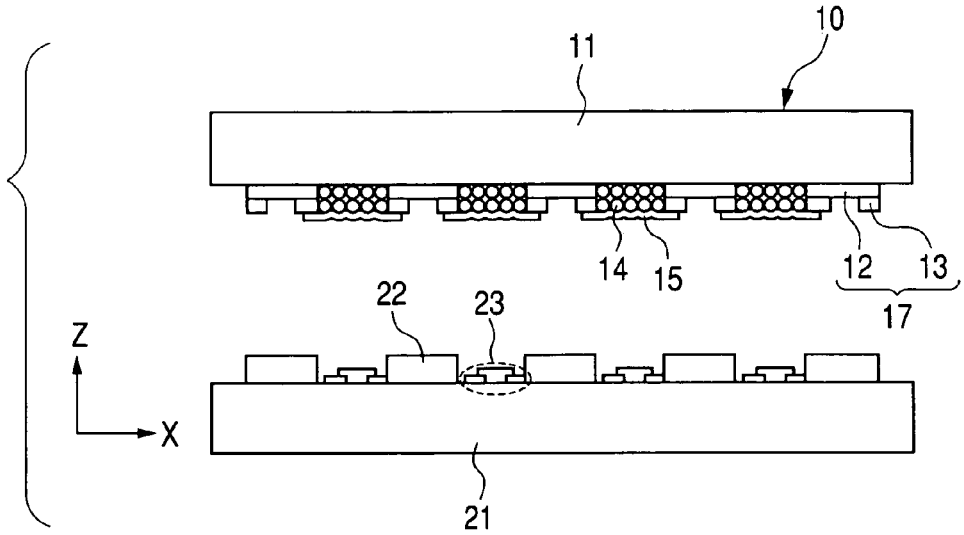
FIGS. 9A, 9B and 9C are schematic views showing a structure according to Example 5 of the invention.
Figure 9B:
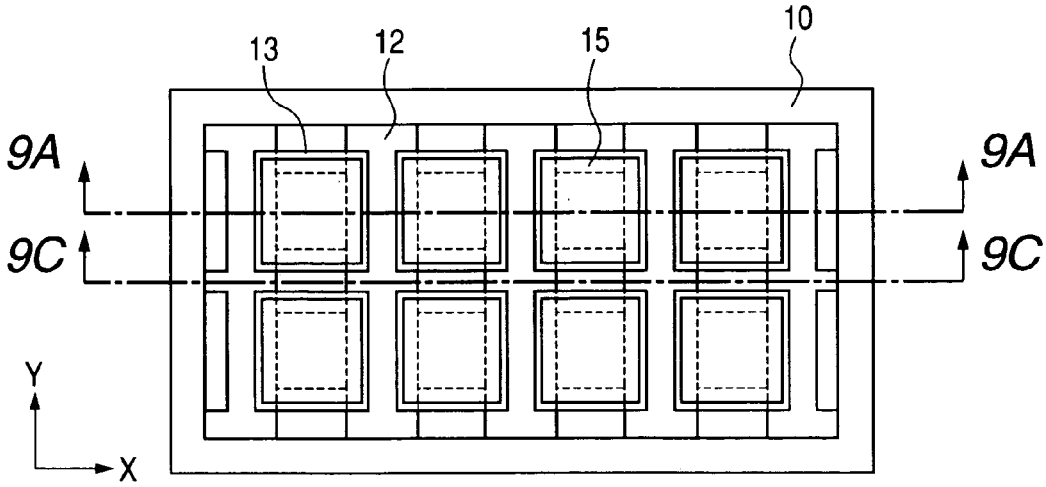
Figure 9C:
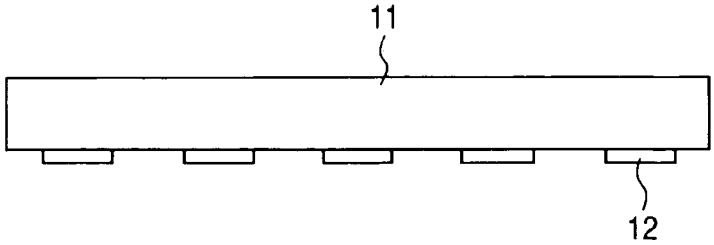

The image display device including the display panel shown in FIG. 9A was produced. FIG. 9B is a schematic plan view when the faceplate 10 is viewed from the side of the rear plate 21, FIG. 9A is a sectional view taken on line 9A-9A of FIG. 9B, and FIG. 9C is a sectional view taken on line 9C-9C of FIG. 9B.

In Example 5, as with Example 3, the conductive area 12 was formed in the stripe shape parallel to the Y-direction. The black matrix was used as the distance specifying member 13, and the black matrix was formed on the stripe-shaped conductive area 12. The black matrix was formed by the photolithography method. In the black matrix, the width was 50 μm and the thickness was 8 μm. The black matrix was separated between the adjacent conductive films 15. Namely, the black matrix in Example 5 was the plurality of ring-shaped distance specifying members 13 which were arranged so as to surround each fluorescent material 14. Thus, the resistance $R_x$ between the adjacent conductive films 15 becomes substantially infinite.

When the resistances $R_x$, $R_z$ and $R_p$ were measured in the same way as Example 1, $R_x$ was not lower than 10 MΩ, $R_z$ was 8 KΩ, and $R_p$ was not more than 1Ω. When the magnitudes of the resistances $R_x$ and $R_z$ were compared to each other by the method similar to Example 1 (FIG. 3), the resistance $R_x$ was larger than the resistance $R_z$.

The faceplate of Example 5 was used to produce the image display device which included the display panel having the structure shown in FIG. 9A. When the high voltage of 18 KV was used as the anode potential, sometimes the discharge was generated. However, the defect that the observer perceived was not generated, and the image display device having the high reliability could be obtained.

In Example 5, since the distance specifying member 13 was separated between the adjacent conductive films 15, the resistance $R_x$ between the adjacent conductive films 15 was increased, which allows the current to be decreased during the discharge. Therefore, the image display device which less subjected to the damage caused by the discharge could be formed.

Example 6

Figure 10A:
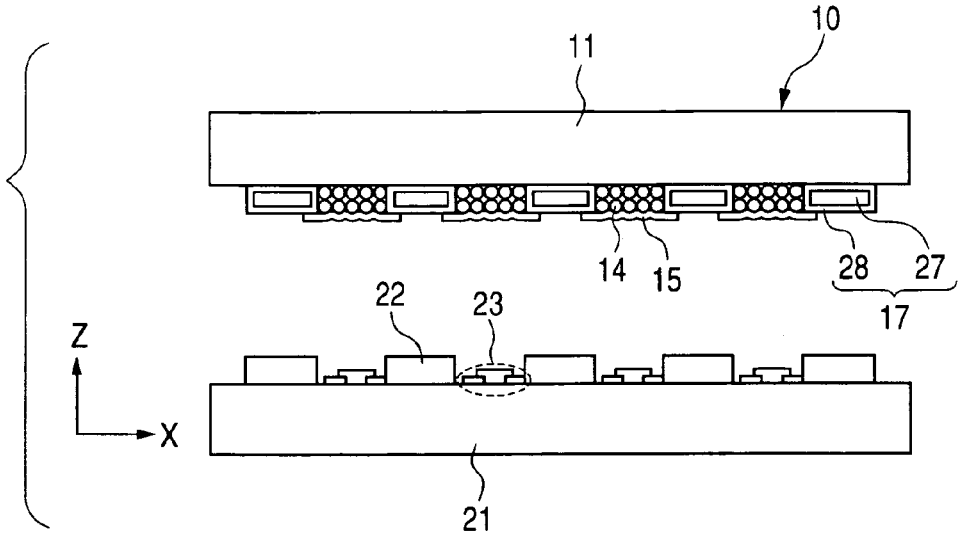
FIGS. 10A, 10B and 10C are schematic views showing a structure according to Example 6 of the invention.
Figure 10B:
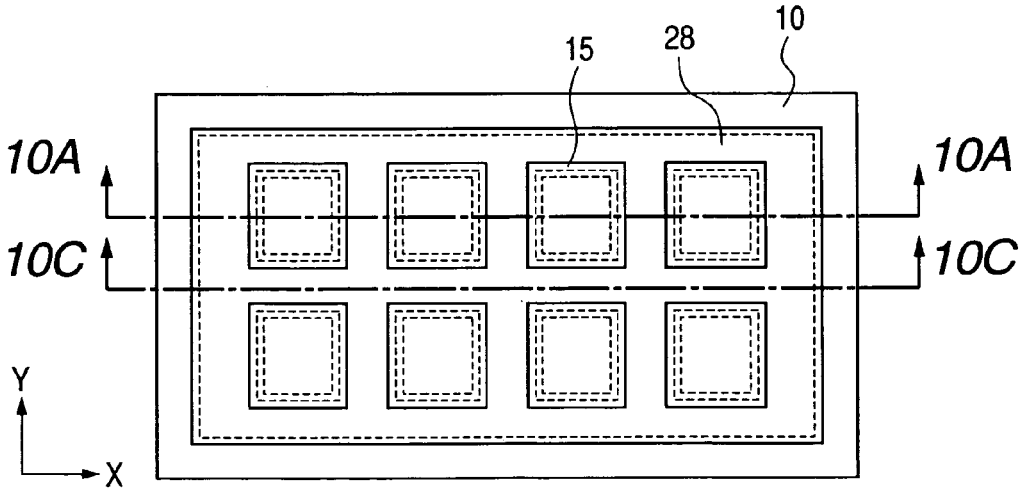
Figure 10C:
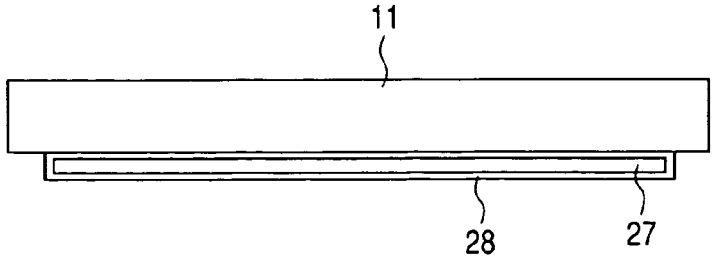

The image display device including the display panel shown in FIG. 10A was produced. FIG. 10B is a schematic plan view when the faceplate 10 is viewed from the side of the rear plate 21, FIG. 10A is a sectional view taken on line 10A-10A of FIG. 10B, and FIG. 10C is a sectional view taken on line 10C-10C of FIG. 10B.

In Example 6, the metal plate having the plurality of openings was used as the opening member 17. The metal plate 27 was coated with the high-resistance member 28, and the metal plate 27 was bonded to the glass substrate with the low-melting glass frit. It is preferable that the material whose thermal expansion coefficient is close to that of the glass substrate is used as the metal substrate 27 so that the metal plate 27 is not peeled off from the glass substrate during the burning. A 436 alloy was used in Example 6. The high-resistance member 28 is not particularly limited as long as the resistances $R_x$ and $R_z$ can be set to the desired values. In Example 6, in consideration of the ease of the production and adhesive properties in the low-melting glass frit, a glaze in which platinum fibers were dispersed was applied and burned to form antistatic glass lining having the thickness of 2 μm. Although the antistatic glass lining was used as the high-resistance member in Example 6, the high-resistance member is not limited to the antistatic glass lining. For example, it is possible to use an oxide film produced by applying the material by a dipping technique in a sol-gel process.

A part of the high-resistance member 28 formed on the metal plate 27 was peeled off, and the exposed portion of the metal plated 27 was electrically connected to the electrode pad (not shown), which allowed the voltage to be provided from the high-voltage power supply.

When the resistances $R_x$, $R_z$ and $R_p$ were measured in the same way as Example 1, $R_x$ was not lower than 10 MΩ, $R_z$ was 200 KΩ, and $R_p$ was not more than 1Ω. When the magnitudes of the resistances $R_x$ and $R_z$ were compared to each other by the method similar to Example 1 (FIG. 3), the resistance $R_x$ was larger than the resistance $R_z$.

The faceplate of Example 6 was used to produce the image display device which included the display panel having the structure shown in FIG. 10A. When the high voltage of 17 KV was used as the anode potential, sometimes the discharge was generated. However, the defect that the observer perceived was not generated, and the image display device having the high reliability could be obtained.

In Example 6, the metal plate 27 and the high-resistance member 28 were used as the opening member 17, so that production cost could be reduced.

Example 7

Figure 11:
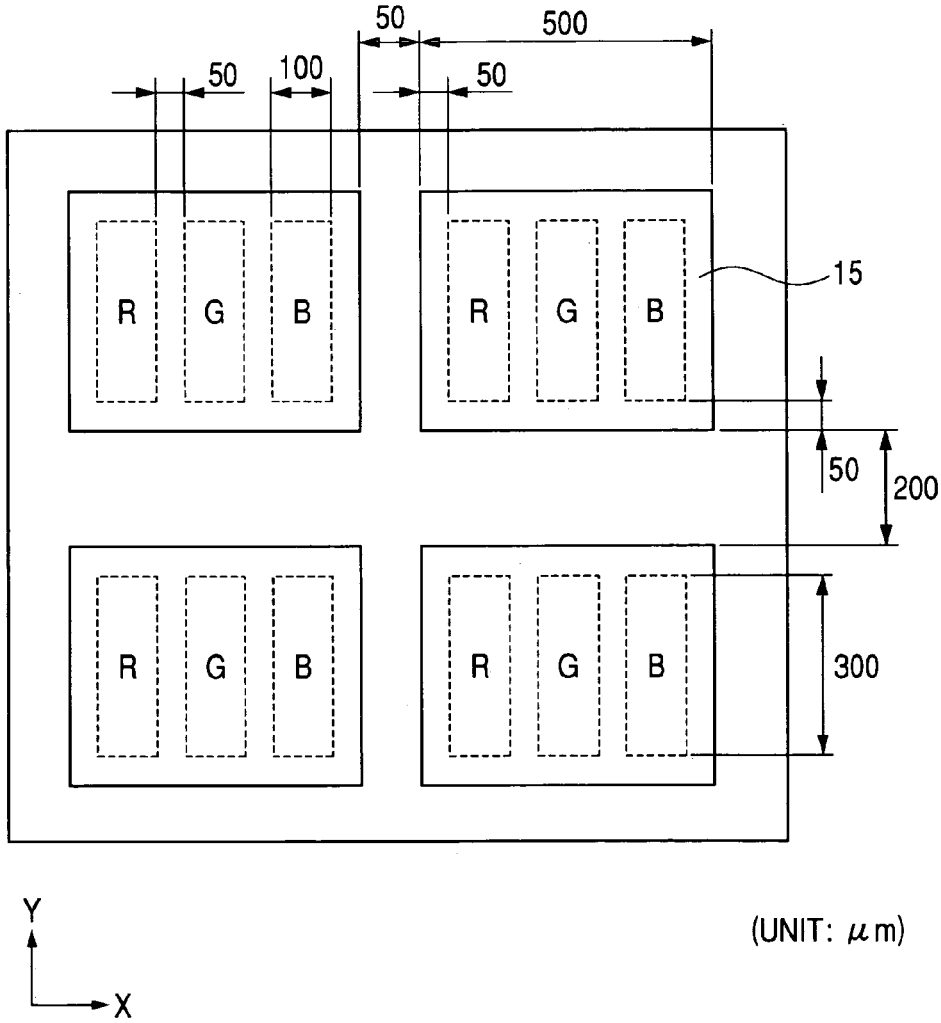
FIG. 11 is a schematic view showing a structure of a faceplate according to Example 7 of the invention.

As shown in FIG. 11, the image display device was produced in the same way as Example 1 except for the configuration in which one pixel including one set of three sub-pixels of R, G, and B was covered with the conductive film 15.

In Example 7, the size of the opening in the black matrix was set to 100 μm by 300 μm, the width of the black matrix between the sub-pixels was set to 50 μm, the width between the pixels was set to 200 μm in the X-direction, and the width between the pixels was set to 300 μm in the Y-direction. The black matrix whose thickness was 5 μm was produced by the photolithography method. The area formed by the three color fluorescent materials of R, G, and B (three sub-pixels) was set to one pixel. The fluorescent material of each color was arranged in each sub-pixel, and the conductive film 15 was provided in each one pixel.

When the resistances $R_x$, $R_z$ and $R_p$ were measured in the same way as Example 1, $R_x$ was 200 KΩ, $R_z$ was 1.5 KΩ, and $R_p$ was 30Ω. When the magnitudes of the resistances $R_x$ and $R_z$ were compared to each other by the method similar to Example 1 (FIG. 3), the resistance $R_x$ was larger than the resistance $R_z$.

When the image display device for which the faceplate of Example 7 was used was used at the high voltage of 15 KV, sometimes the discharge was generated. However, the defect that the observer perceived was not generated, and the image display device having the high reliability could be obtained.

The problems, in which the width of the black matrix was too narrow to separate the conductive film 15 between the sub-pixels and the resistance $R_x$ was not larger than the resistance $R_z$ due to the short distance even if the conductive film 15 could be separated, could be avoided by arranging the conductive film 15 in each pixel in Example 7.

Example 8

Figure 12:
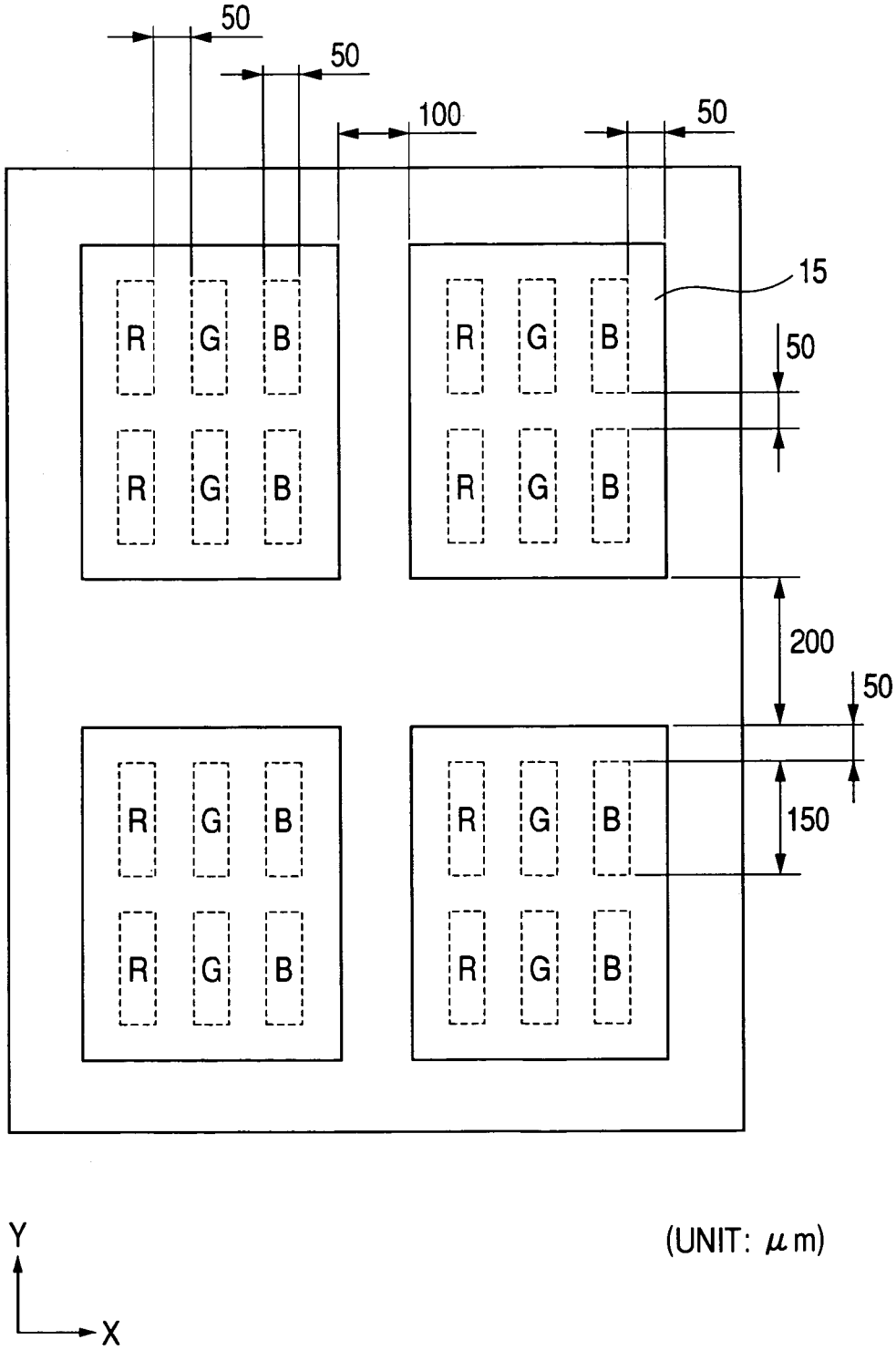
FIG. 12 is a schematic view showing a structure of a faceplate according to Example 8 of the invention.

As shown in FIG. 12, the image display device was produced in the same way as Example 1 except for the configuration in which two pixels were covered with the conductive film 15.

In Example 8, the size of the opening in the black matrix was set to 50 μm by 100 μm, the width of the black matrix between the sub-pixels was set to 50 μm, the width between the pixels was set to 200 μm in the X-direction, and the width between the pixels was set to 300 μm in the Y-direction. The black matrix whose thickness was 5 μm was produced by the photolithography method. The area formed by the three color fluorescent materials of R, G, and B (three sub-pixels) was set to one pixel. The fluorescent material of each color was arranged in each sub-pixel, and the conductive film 15 was provided in each two pixel.

When the resistances $R_x$, $R_z$ and $R_p$ were measured in the same way as Example 1, $R_x$ was 200 KΩ, $R_z$ was 600Ω, and $R_p$ was 30Ω. When the magnitudes of the resistances $R_x$ and $R_z$ were compared to each other by the method similar to Example 1 (FIG. 3), the resistance $R_x$ was larger than the resistance $R_z$.

The faceplate of Example 7 was used to produce the image display device having the structure shown in FIG. 4. When the image display device was used at the high voltage of 14 KV, sometimes the discharge was generated. However, the defect that the observer perceived was not generated, and the image display device having the high reliability could be obtained.

The problems, in which the width of the black matrix was too narrow to separate the conductive film 15 and the resistance $R_x$ was not larger than the resistance $R_z$ due to the short distance even if the conductive film 15 could be separated, could be avoided by arranging the conductive film 15 in each pixel in Example 8.

This application claims priority from Japanese Patent Application No. 2004-040757 filed Feb. 18, 2004, which is hereby incorporated by reference herein.

What is claimed is:

1. A substrate used for an image display device, comprising:

(A) a first substrate which has a member having a plurality of openings on its surface;

(B) light emitters which are arranged in the plurality of openings respectively;

(C) a plurality of conductive films arranged to cover the light emitters; and (D) an electrode pad which is connected to a power supply for providing potential to the plurality of conductive films, wherein the member having the plurality of openings has a conductive area, the conductive area is electrically connected to the electrode pad, each of the plurality of conductive films is in contact with the member having the plurality of openings, the minimum value of resistances $R_x$ between the two conductive films adjacent to each other in the plurality of conductive films is larger than the minimum value of resistances $R_z$ between the conductive area and the plurality of conductive films, and a resistance $R_p$ in a range from the conductive area to the electrode pad is smaller than the resistance $R_z$ in a range from the conductive area to each of the plurality of conductive films.

2. A substrate according to claim 1, wherein the conductive area of the member having the plurality of openings is formed on a side of a substrate surface side of the member.

3. A substrate according to claim 1, wherein the conductive area of the member having the plurality of openings is a second conductive film which is arranged on the substrate surface.

4. A substrate according to claim 3, wherein the second conductive film is the conductive film transparent to visible light, and the second conductive film is also arranged between the light emitters and the first substrate.

5. A substrate according to claim 1, wherein the minimum value of the resistance between the conductive area and the plurality of conductive films is larger than 500Ω.

6. A substrate according to claim 1, wherein the minimum value of the resistance between the conductive area and the plurality of conductive films is smaller than 1 MΩ.

7. A substrate according to claim 1, wherein the minimum value of the resistance between the two conductive films adjacent to each other in the plurality of conductive films is larger than 1 KΩ.

8. A substrate according to claim 1, wherein the minimum value of the resistance between the two conductive films adjacent to each other in the plurality of conductive films is larger than 1 MΩ.

9. A substrate according to claim 1, wherein the light emitters emit respectively lights of red, blue, and green, and the light emitters which emit respectively the lights of the red, blue, and green are sequentially arranged in the plurality of openings.

10. A substrate according to claim 9, wherein each of the plurality of conductive films is arranged in each pixel, and the opening in which the light emitter which emits the light of any one of colors of the red, blue, and green is arranged is set as one pixel.

11. A substrate according to claim 9, wherein each of the plurality of conductive films is arranged in each pixel, the opening in which the light emitter which emits the light of any one of colors of the red, blue, and green is arranged is set as one sub-pixel, and the three-color light emitters which emit the light of each color of the red, blue, and green are set as one pixel.

12. A substrate according to claim 9, wherein each of the plurality of conductive films is arranged in each of two pixels, the opening in which the light emitter which emits the light of any one of colors of the red, blue, and green is arranged is set as one sub-pixel, and the three-color light emitters which emit the light of each color of the red, blue, and green are set as one pixel.

13. An image display device comprising:

a substrate having a light emitter; and a rear plate which has a plurality of electron-emitting devices, wherein the substrate is a substrate according to claim 1.

14. A substrate used for an image display device, comprising:

(A) a first substrate which has a resistance member including a plurality of openings on its surface;

(B) light emitters which are arranged in the plurality of openings respectively;

(C) a plurality of conductive films which are arranged so as to be connected to the resistance member, the light emitters arranged inside each of the plurality of openings being covered with the conductive films, the conductive films being separated from each other at an interval; and (D) an electrically conductive area being electrically connected to the plurality of conductive films via the resistance member, wherein the minimum value of resistance $R_x$ between the two conductive films adjacent to each other in the plurality of conductive films is higher than the minimum value of resistances $R_z$ between the conductive area and the plurality of conductive films.

15. A substrate according to claim 14, further comprising an electrode pad which is connected to the conductive area in order to provide potential to each of the plurality of conductive films, wherein a resistance $R_p$ in a range from the conductive area to the electrode pad is lower than the resistance $R_z$ in a range from the conductive area to each of the plurality of conductive films.

16. A substrate according to claim 14, wherein the conductive area is arranged between the resistance member and the first substrate.

17. A substrate according to claim 14, wherein the minimum value of the resistance between the conductive area and each of the plurality of conductive films is larger than 500Ω.

18. A substrate according to claim 14, wherein the minimum value of the resistance between the conductive area and each of the plurality of conductive films is smaller than 1 MΩ.

19. A substrate according to claim 14, wherein the minimum value of the resistance between the conductive area and the plurality of conductive films is larger than 1 KΩ.

20. A substrate according to claim 14, wherein the minimum value of the resistance between the conductive area and the plurality of conductive films is larger than 1 MΩ.

21. An image display device comprising:

a rear plate which has a plurality of electron-emitting devices; and a substrate which includes light emitters for emitting light by irradiation of electrons emitted from the electron-emitting device, wherein the substrate is a substrate according to claim 14.

22. An information displaying/reproducing apparatus comprising:

an image display device which has a screen;

a receiver which outputs at least one of video information, character information, and audio information which are included in a received broadcasting signal; and a drive circuit which displays the information outputted from the receiver on the screen of the image display device, wherein the image display device is an image display device according to claim 21.

23. A substrate comprising:

a first substrate;

a plurality of fluorescent materials which are arranged on the first substrate while separated from one another;

a plurality of conductive films which are arranged while separated from one another so that each of the plurality of fluorescent materials is covered with the conductive film; and a conductive member which is located between the plurality of conductive films, the conductive member being directly connected to each of the plurality of conductive films, wherein potential is supplied to the plurality of conductive films through the conductive member, and a resistance distribution of the conductive member is adjusted so that a resistance $R_x$ of the conductive member between the adjacent conductive films is larger than a resistance $R_z$ of the conductive member located in a range from each of the conductive films to a potential provision terminal.

* * * * *

UNITED STATES PATENT AND TRADEMARK OFFICE

CERTIFICATE OF CORRECTION

PATENT NO. : 7,312,770 B2
APPLICATION NO. : 11/043076
DATED : December 25, 2007
INVENTOR(S) : Tomoya Onishi It is certified that error appears in the above-identified patent and that said Letters Patent is hereby corrected as shown below:

[57] ABSTRACT:

Line 10, "resistance $R_Z$," should read --resistance $R_Z$--.

COLUMN 3:

Line 9, "the, electrode" should read --the electrode--.

COLUMN 6:

Line 16, "resistance $R_x$" should read --resistance $R_X$--.

Line 59, "$(I2+I3)\times R_x$" should read --$(I2+I3)\times R_X$-- and "and,the" should read --and the--.

COLUMN 7:

Line 41, "by-the" should read --by the--.

COLUMN 10:

Line 53, "distance." should read --distance--.

Signed and Sealed this

Third Day of February, 2009

John Doll

JOHN DOLL
*Acting Director of the United States Patent and Trademark Office*